United States Patent [19]

Marshall et al.

[11] Patent Number: 4,621,976

[45] Date of Patent: Nov. 11, 1986

[54] INTEGRALLY CAST VANE AND SHROUD STATOR WITH DAMPER

[75] Inventors: Larry A. Marshall, Tequesta; David A. Lewis, Stuart, both of Fla.

[73] Assignee: United Technologies Corporation, Hartford, Conn.

[21] Appl. No.: 726,260

[22] Filed: Apr. 23, 1985

[51] Int. Cl.[4] ..... F01D 9/04

[52] U.S. Cl. ..... 415/191; 415/119; 415/218; 416/500

[58] Field of Search ..... 415/119, 135, 136, 137, 415/138, 189, 190, 191, 216–218, 173 R; 416/193 A, 500; 248/628

[56] References Cited

U.S. PATENT DOCUMENTS

| | | | |
|---|---|---|---|
| 1,730,168 | 10/1929 | Schiffmann | 248/628 X |
| 2,749,026 | 6/1956 | Hasbrouck et al. | 415/217 UX |
| 2,772,852 | 12/1956 | Stalker | 416/500 X |
| 3,644,057 | 2/1972 | Steinbarger | 415/218 |
| 4,285,633 | 8/1981 | Jones | 415/191 |
| 4,470,754 | 9/1984 | Manente et al. | 415/173 R X |

FOREIGN PATENT DOCUMENTS

| | | | |
|---|---|---|---|
| 751646 | 9/1933 | France | 415/173 R |
| 1009619 | 11/1965 | United Kingdom | 415/191 |
| 2110768 | 6/1983 | United Kingdom | 415/217 |

*Primary Examiner*—Robert E. Garrett
*Assistant Examiner*—Joseph M. Pitko
*Attorney, Agent, or Firm*—Jack N. McCarthy

[57] ABSTRACT

An integrally cast stator is formed having an annular array of vanes connected at their outer ends to an outer shroud and connected at their inner ends to an inner shroud, said outer shrouds of adjacent cast stators having a snap fit, said inner shroud having an annular C-shaped channel integrally formed within its inner surface by an inwardly extending radial flange and rearwardly extending cylindrical flange. An annular spring damping device having an outer annular arm and an inner annular arm, said damping device being positioned in said annular C-shaped channel with said inner annular arm fixed in said C-shaped channel inwardly of said inner shroud and with said outer annular arm biased against said inner surface of said inner shroud. A modification has two annular C-shaped channels.

14 Claims, 5 Drawing Figures

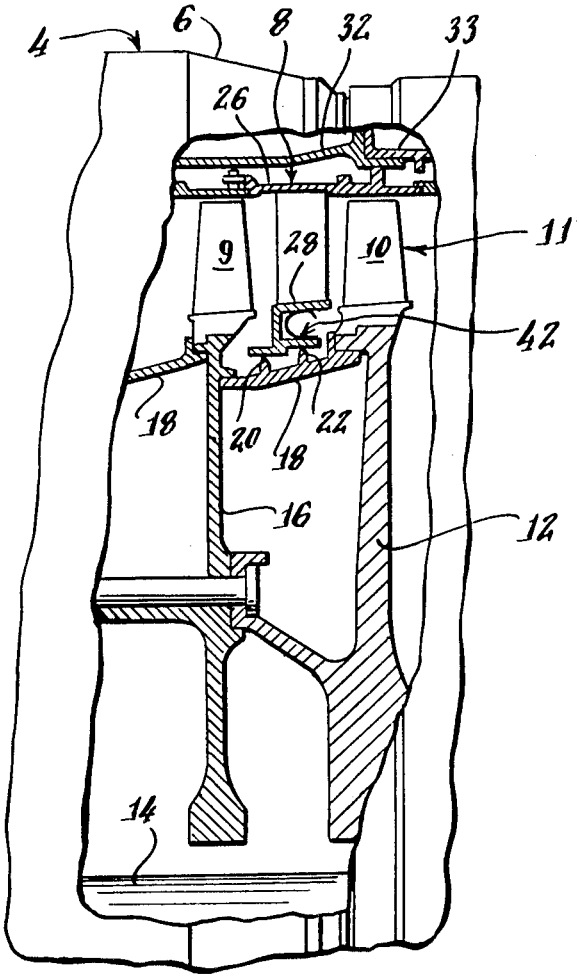
Fig. 1.
Fig. 2.
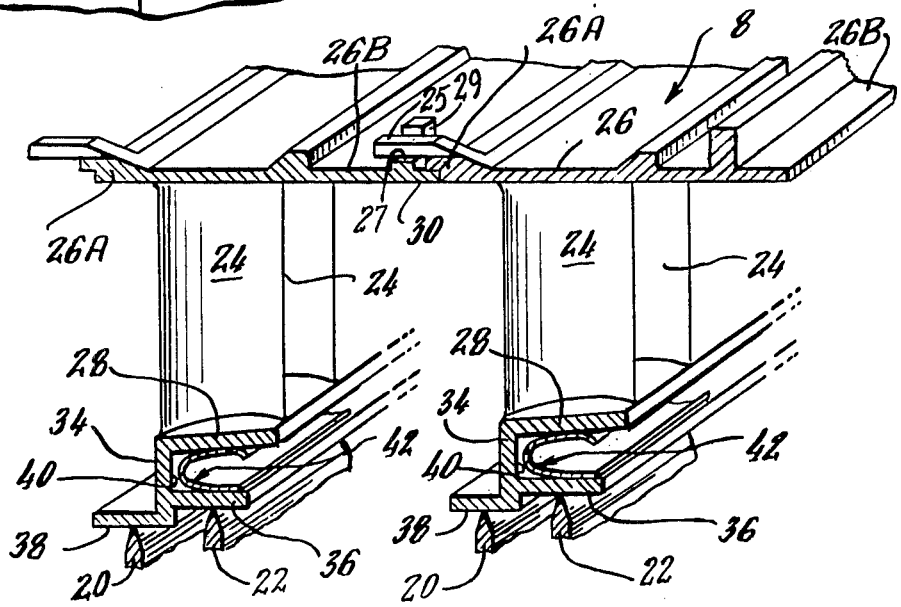

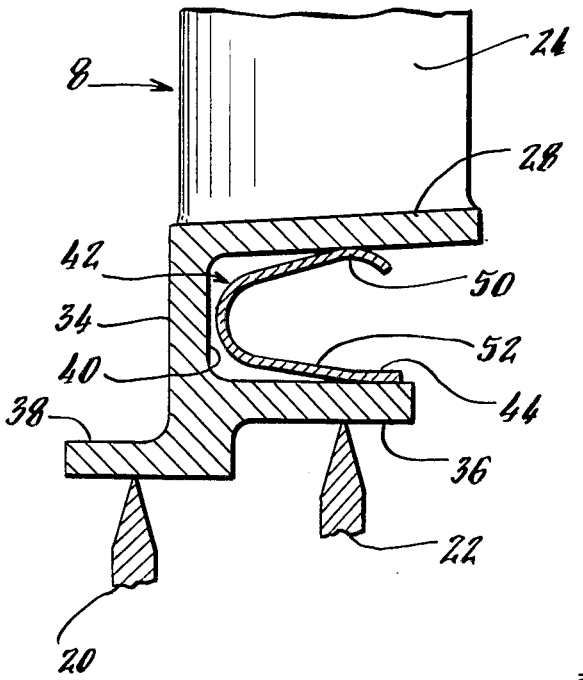
Fig. 3
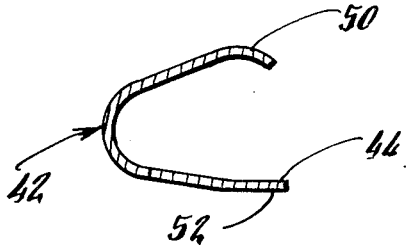
Fig. 4
Fig. 5.
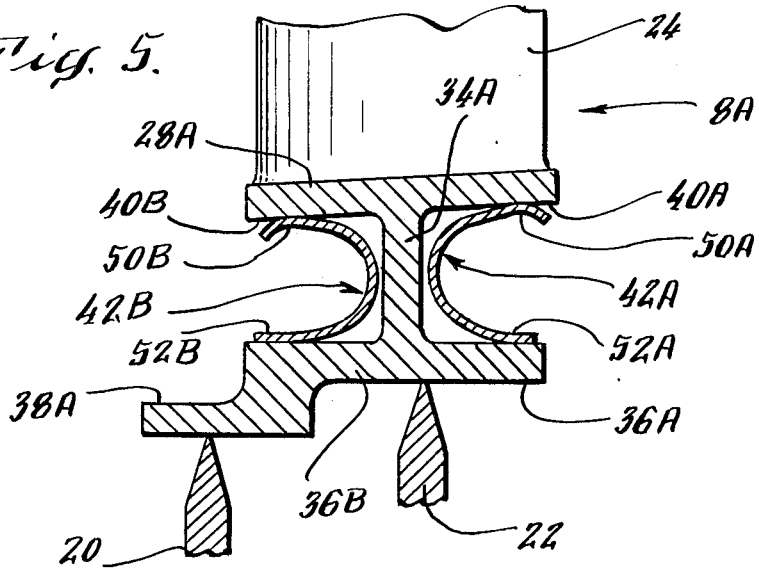

INTEGRALLY CAST VANE AND SHROUD STATOR WITH DAMPER

The Government has rights in this invention pursuant to Contract No. N00019-82-C-0241 awarded by the Department of the Navy.

BACKGROUND OF THE INVENTION

1. Field of Invention

This invention relates to a vane and shroud stator, which is integrally cast, having spring means for damping the unit.

2. Description of the Prior Art

Axial flow gas turbine compressors have been constructed of alternate sets of rotors and stators of a quantity and specific design as needed to meet the flow and pressure requirements of an engine cycle. The stators are constructed of an annular array of identical airfoils, or vanes, supported at one or both ends by circular rings. These rings, in addition to structurally supporting the airfoils, or vanes, also provide flowpath boundaries, and the inner rings, if used, often serve to support seal lands. These rings are often referred to as "shrouds". Stators constructed as a fabrication are assembled by attaching the required number of airfoils, or vanes, to the inner and outer shrouds. A number of optional attachment features exist including riveting, brazing, welding or staking the vanes to the shrouds at one or both ends. A fabricated stator assembly is shown in U.S. Pat. No. 4,285,633.

Due to vibratory excitation of the vanes by the turbulence and periodic perturbations in the airflow across the vanes, the vanes will vibrate at one or more of their natural frequencies. This vibration produces stresses and deflections in the vanes that can produce fatigue and wear. When a vane attachment to the shroud ring allows relative motion between these parts, beneficial friction damping is introduced. This friction damping is desirable in that it dissipates vibratory energy in the system and reduces vibratory stress and deflections improving vane durability. However, since the rubbing can produce wear, it may be undesirable in the long term if the wear progresses at a rate that is not consistent with the life requirements of the stator assembly.

To alleviate the expense and complexity of fabricated stator designs, entire stator assemblies are being cast as one piece, with the vanes and shrouds becoming integral homogenous elements of the entire stator. Although the cast construction improves cost and provides simplicity and consistency, its one-piece construction eliminates the relative motion between the vanes and the shrouds and therefore eliminates the built-in friction damping of the fabricated stator assembly.

A cast stator, which is an integral unit, will vibrate in a different manner than a fabricated assembly. Since the vanes are integral with the shrouds, vane vibratory motion is shared with one or both shrouds in a more complex motion than that which occurs in a stator fabricated of vane and shroud components. In the cast, integral, stator, bending and torsional modes of vibration of the vanes occur in concert with various elaborate nodal diameter patterns of vibration in the shrouds. The total vibration energy input to the system is coupled between the vanes and the shrouds.

DISCLOSURE OF THE INVENTION

An object of the present invention is to provide an integrally cast stator having an inner and outer shroud with vanes therebetween, an integral C-shaped annular channel is formed within the inner shroud of the cast assembly, said annular C-shaped channel having its open end facing rearwardly and having an annular spring damping device positioned therein having two arms, with one arm of the spring damping device being fixed to one side of the C-shaped annular channel, and the other arm of the spring damping device being biased against the inner shroud of the C-shaped annular channel preloading the stator; said annular spring damping device having a C-shaped cross-section having an inner and outer arm.

Another object of the present invention is to provide a damping device for an integrally cast stator which will have adequate durability and wear while retaining the desirable features inherent in a unitary cast configuration. Placing the damping device in an annular recess located radially inwardly from the inner shroud positions it outside of the flowpath through the vanes of the stator.

A further object of the invention is to provide an inexpensive and light damping device preloaded against the inner shroud of an integrally cast stator to remove energy when the vanes and shrouds vibrate due to an engine operating condition whereby the preload can be easily varied by mechanical design to obtain a desired frictional force level.

Another object of the present invention is to provide an integrally cast stator having two annular C-shaped channels, each having a spring damping device which can be placed in its channel with its own preload which can be varied.

A further object of the present invention is to provide a wear resistant coating between the contacting damper surface and shroud surface to prolong the life of the damper and shroud surfaces.

BRIEF DESCRIPTION OF THE DRAWINGS

FIG. 1 is a view of a portion of the compressor section of an axial flow gas turbine engine with a broken away area showing two compressor disks with blades having an integrally cast vane and shroud stator positioned therebetween;

FIG. 2 is an enlarged view of two adjacent stages of cast stators showing their outer shroud mating fit and inner shroud damping device;

FIG. 3 is an enlarged view of the integrally cast inner shroud showing an annular C-shaped channel and annular C-shaped spring damping device fixed therein;

FIG. 4 is a view of the annular C-shaped spring damping device of FIG. 3 shown in a relaxed position; and FIG. 5 is a view similar to FIG. 3 showing a modification having two annular C-shaped channels.

BEST MODE FOR CARRYING OUT THE INVENTION

The compressor section 4 of a gas turbine engine is shown in FIG. 1 having its outer casing 6 broken away to show the cast stator 8 between the last two rows of blades 9 and 10 of a multistage axial flow compressor 11. The final disk 12, containing blades 10 at its outer periphery, is fixed on the drive shaft 14 and bolted to the disk 16, containing blades 9 at its outer periphery, which is in turn bolted to the disks of the other forward stages; axial spacers 18 separate adjacent disks. Each spacer 18 has two axially spaced annular knife-edge seal members 20 and 22 extending outwardly therearound.

The cast stator 8 is integrally formed having an annular array of airfoils, or vanes 24, connected at their outer ends to an outer shroud 26 and connected at their inner ends to an inner shroud 28.

Each outer shroud 26 has an annular flange portion 26A extending forwardly thereof and an annular flange portion 26B extending rearwardly thereof for mating with the cooperating annular flange portions of the outer shroud 26 of adjacent cast stators 8. The first cast stator 8 of the plurality of stages has its portion 26A mating with an engine casing part and the last cast stator 8 of the plurality of stages has its portion 26B mating with an engine casing part.

The rearwardly extending annular flange portion 26B is longer than the forwardly extending annular flange portion 26A and extends over the tips of the blades downstream of a cast stator 8. The mating ends of the outer shrouds 26 have a machined cylindrical snap connection 30 therebetween. This maintains the outer shrouds 26 together along with radial support connections with the outer casing 6; one such connection being shown at 32 and one at 33. A plurality of forward projections 25 extend from the forward end of each outer shroud portion 26A. Each projection 25 engages a cooperating groove 27 in a matching radial projection 29 extending from the rearward end of each outer shroud portion 26B. This arrangement prevents rotational movement therebetween.

Each inner shroud 28 is located around an axial spacer 18 and has an inwardly extending radial flange 34 integrally connected to the forward edge thereof. A cylindrical flange 36 extends rearwardly from the radial flange 34 adjacent its inner end, and extends for a distance slightly less than the length of the inner shroud 28. A cylindrical flange 38, located inwardly from cylindrical flange 36, extends forwardly from the inner end of the radial flange 34 for a short distance.

Cylindrical flange 36 forms an annular C-shaped channel, or recess, 40, with inner shroud 28 and radial flange 34, for a purpose to be hereinafter described. The inner surface of cylindrical flange 36 becomes a cylindrical seal land for knife-edge seal member 22 and the inner surface of cylindrical flange 38 becomes a cylindrical seal land for knife-edge seal member 20.

An annular C-shaped spring damping device 42 is placed in the C-shaped channel 40, and the inner arm 52 of the C-shaped spring damping device 42 is mechanically attached to the cylindrical flange 36 such as by welding, brazing, bolting or riveting. The other outer arm 50 of the C-shaped spring damping device 42 is biased, and bears, against the inside surface of the inner shroud 28. The relaxed position of the two arms of the C-shaped spring damping device 42 is shown in FIG. 4; the compressed position is shown in FIG. 3. The annular damping device 42 can be formed as a split "ring" for ease of installation and fabrication.

The annular C-shaped spring damping device 42 is formed having a flat portion 44 at the end of the arm 52 for attachment to the cylindrical flange 36 (see FIG. 3). The damping device 42 then angles forwardly and outwardly away from cylindrical flange 36 and curves in a radius, spaced from radial flange 34, to extend rearwardly and outwardly towards the inner shroud 28, where it curves inwardly and is biased against the inner side of the inner shroud 28.

The annular C-shaped spring damping device 42 provides a preloaded spring force around the inner periphery of the inner shroud 28 at the temperature and pressure environment for all operating conditions of the engine at a level of force which will allow relative movement to provide the proper energy dissipation whenever the vibratory deflections of the shroud are of a magnitude that would create significant vibratory stress. At engine speeds when the periodic excitation of the stator vanes 24 coincides with a natural frequency, the vanes 24, as well as the attached inner and outer shrouds 26 and 28, will vibrate. Vibratory deflections in the inner shroud 28 cause rubbing contact with the damping device 42. The magnitude of the relative motion between the inner shroud 28 and the damping device 42, multiplied by the frictional force created between the two surfaces, constitutes a measure of the vibratory energy dissipated by the damper system (preloaded spring force acting on the inner shroud times the coefficient of friction of the rubbing surfaces equals the frictional force). Removing energy from the vibrating system limits the vibratory stresses and deflections to which the stator will be subjected. The preloaded spring force desired to act on the inner shroud is achieved by the mechanical design of the annular recess in the stator which receives the spring damping device and the spring damping device itself. This preloaded spring force is one determined by testing or analysis. A specific engine is run under operating conditions with instrumentation to determine the most desirable spring force for that engine. This preloaded spring force must limit the vibratory stresses and deflections to a value acceptable to safe operation of the engine.

FIG. 5 shows a modified cast stator 8A wherein the inner shroud 28A is formed having an inwardly extending radial flange 34A integrally connected to the central portion thereof. A cylindrical flange 36A extends rearwardly and a cylindrical flange 36B extends forwardly from the radial flange 34A adjacent its inner end. A cylindrical section 38A extends forwardly from cylindrical flange 36B to provide a cylindrical seal land. Two annular C-shaped channels 40A and 40B are formed with inner shroud 28A and radial flange 34A. The inner surface of cylindrical flange 36A becomes a cylindrical seal land for knife-edge seal member 22 and, as hereinbefore mentioned, the inner surface of cylindrical flange 38A becomes a cylindrical seal land for knife-edge seal member 20.

An annular C-shaped spring damping device 42A is placed in the C-shaped channel 40A in the same manner as the annular C-shaped spring damping device 42 of FIG. 3 and an annular C-shaped spring damping device 42B is placed in the C-shaped channel 40B in the same manner as the annular C-shaped spring damping device 42 and 42A. The inner arms 52A and 52B are mechanically attached at a flat portion to the cylindrical flange 36A. The other outer arms 50A and 50B are biased against the inner surface of the inner shroud 28A at two locations. As mentioned for the modification in FIG. 3, the damping devices 42A and 42B can be formed in a split manner for ease of installation and construction.

It can be seen that the two C-shaped spring damping devices 42A and 42B can provide two preloaded spring forces around the inner periphery of the inner shroud 28A. Each of these preloaded spring forces can be varied as determined by testing or analysis to provide a desired total optimum loading against the inner surface of the inner shroud.

In a construction built of a multistage axial flow compressor having 16 stages, the stator 8 of the 15th stage was cast having an inner arrangement as set forth in FIG. 3. The stator 8 was cast from INCO 718 and the annular C-shaped spring damping device 42 was formed from a sheet of INCO 718. The flat portion 44 of arm 52 was welded to the cylindrical flange 36. The circular preload between the outer arm of the damping device 42 and the inner surface of the inner shroud 28 provides the desired force for damping; this preloaded spring force level was made 50 lbs. per inch (2.54 cm) of circumference for this construction.

Although the invention has been shown and described with respect to preferred embodiments thereof, it should be understood by those skilled in the art that various changes and omissions in the form and detail thereof may be made therein without departing from the spirit and the scope of the invention.

We claim:

1. An integrally cast stator for an axial flow gas turbine engine including an annular array of vanes integrally connected at their outer ends to an outer shroud and integrally connected at their inner ends to an inner shroud; said inner shroud having a forward edge and a rearward edge; an inwardly extending radial flange integrally connected to the inner shroud; a cylindrical flange extending from the radial flange and extending under the inner shroud; said inner shroud, radial flange and cylindrical flange forming an annular C-shaped channel; an annular spring damping device having two annular arms; said annular spring damping device being located in said annular C-shaped channel; said annular spring damping device having one annular arm fixed within said C-shaped channel; said annular spring damping device having said other annular arm biased against said inner shroud providing a preload on said inner shroud to obtain a desired frictional force level.

2. An integrally cast stator as set forth in claim 1 wherein said inwardly extending flange is connected to one edge of the inner shroud.

3. An integrally cast stator as set forth in claim 1 wherein said annular C-shaped channel opens rearwardly.

4. An integrally cast stator as set forth in claim 1 wherein said annular spring damping device has an inner annular arm and an outer annular arm.

5. An integrally cast stator as set forth in claim 4 wherein said inner annular arm has a flat portion fixed within said C-shaped channel inwardly of said inner shroud, said outer annular arm having a curved portion biased against said inner shroud.

6. An integrally cast stator as set forth in claim 5 wherein said flat portion of said inner annular arm is fixed to said cylindrical flange.

7. An integrally cast stator as set forth in claim 1 wherein said annular spring damping device is C-shaped in cross-section.

8. An integrally cast stator as set forth in claim 7 wherein said annular C-shaped spring damping device has inner and outer annular arms, said annular C-shaped spring damping device having a relaxed position where the outer surfaces of the C-shape are spaced apart a distance greater than the distance between the inner shroud and the cylindrical flange of the annular C-shaped channel, said annular C-shaped spring damping device having said inner annular arm fixed to said cylindrical flange, said annular C-shaped spring damping device having said outer annular arm biased against said inner shroud providing a preload on said inner shroud to obtain a desired frictional force level.

9. An integrally cast stator as set forth in claim 1 wherein a second annular C-shaped channel is formed under said inner shroud; a second annular spring damping device having two annular arms; said second spring damping device being located in said second C-shaped channel, said second annular spring damping device having one annular arm fixed within said second C-shaped channel; said annular spring damping device having said other annular arm biased against said inner shroud providing a preload on said inner shroud to obtain a desired frictional force level, said preloads being predetermined to provide a desired optimum loading along the inner surface of the inner shroud.

10. An integrally cast stator as set forth in claim 1 where the preload on said inner shroud is made a value to obtain a desired frictional force level and limit any vibratory stresses and deflections to an acceptable value.

11. An integrally cast stator as set forth in claim 10 where the preload was made 50 lbs. per inch of circumference of said inner shroud.

12. An integrally cast stator for an axial flow gas turbine engine including an annular array of vanes integrally connected at their outer ends to an outer shroud and integrally connected at their inner ends to an inner shroud; said inner shroud having a forward edge and a rearward edge; an inwardly extending radial flange integrally connected to the inner shroud; a cylindrical flange extending from the radial flange and being integrally connected adjacent the inner end of the radial flange; said inner shroud, radial flange and cylindrical flange forming an annular C-shaped channel; an annular C-shaped spring damping device having inner and outer annular arms; said inner and outer annular arms having an inner and outer surface; said annular C-shaped spring damping device having a relaxed position where the inner and outer surfaces of the C-shape are spaced apart at one point a distance greater than the distance between the inner shroud and the cylindrical flange of the annular C-shaped channel; said annular C-shaped spring damping device being located in said annular C-shaped channel; said annular C-shaped spring damping device having said inner surface of said inner annular arm fixed to said cylindrical flange; said annular C-shaped spring damping device having said outer surface of said outer annular arm biased against said inner shroud providing a preload on said inner shroud to obtain a desired frictional force level.

13. A method of forming an integrally cast stator for an axial flow gas turbine engine having a damper including:

(1) casting a stator having an annular array of airfoils connected at their outer ends to an outer shroud and connected at their inner ends to an inner shroud; said inner shroud having a forward edge and a rearward edge;

(2) casting integrally therewith an inwardly extending radial flange connected to the inner shroud with a cylindrical flange extending from the radial flange adjacent its inner end; said inner shroud, radial flange and cylindrical flange forming an annular C-shaped channel;

(3) forming an annular C-shaped spring damping device having outer surfaces for placing in the annular C-shaped channel; said annular C-shaped spring damping device having a relaxed position where the outer surfaces of the C-shape are spaced apart a distance greater than the distance between the inner shroud and the cylindrical flange of the annular C-shaped channel;

(4) compressing the annular C-shaped spring damping device and placing it in the annular C-shaped channel;

(5) fixing the inner arm of the spring damping device to the cylindrical flange with the outer arm being biased against the inner surface of the inner shroud; said spring damping device providing a preload to obtain a desired frictional force level.

14. A method as set forth in claim 13 wherein step (4) said annular C-shaped spring damping device is compressed to provide a preload of 50 lbs. per inch of circumference of said inner shroud.

* * * * *